US006269604B1

(12) United States Patent
Pedersen

(10) Patent No.: US 6,269,604 B1
(45) Date of Patent: Aug. 7, 2001

(54) ROOF CLADDING ELEMENT, SYSTEM AND USE OF THE ELEMENTS

(75) Inventor: Torben Pedersen, Gram (DK)

(73) Assignee: Lindab A/S, Haderslev (DK)

( * ) Notice: Subject to any disclaimer, the term of this patent is extended or adjusted under 35 U.S.C. 154(b) by 0 days.

(21) Appl. No.: 09/536,429

(22) Filed: Mar. 27, 2000

Related U.S. Application Data

(63) Continuation of application No. PCT/IB98/01493, filed on Sep. 24, 1998, now abandoned.

(30) Foreign Application Priority Data

Sep. 26, 1997 (SE) ..... 9703472

(51) Int. Cl.[7] ..... E04D 3/24
(52) U.S. Cl. ..... 52/537; 52/748.1
(58) Field of Search ..... 52/518, 537, 748.1

(56) References Cited

U.S. PATENT DOCUMENTS

| | | | | |
|---|---|---|---|---|
| 1,816,439 | * | 7/1931 | Masters | 52/537 X |
| 2,076,989 | * | 4/1937 | Halpham | 52/537 |
| 4,262,462 | * | 4/1981 | Melbye | 52/537 X |

FOREIGN PATENT DOCUMENTS

| | | | | |
|---|---|---|---|---|
| 1148058 | * | 5/1963 | (DE) | 52/537 |
| 297 00 208 U1 | | 4/1997 | (DE) . | |
| 29700208 | | 4/1997 | (DE) . | |
| 2460378 | * | 2/1981 | (FR) | 52/537 |
| 11247 | | 1/1916 | (GB) . | |
| 203132 | * | 9/1923 | (GB) | 52/537 |
| 430933 | | 6/1935 | (GB) . | |

OTHER PUBLICATIONS

Keasbey & Mattison Product Brochure, Jun. 1952, pp. 25–26.*
*Gi'dit hus en ny profil*, Danish Lindab brochure, 1994.
*Vejledning –projectering og montage*, Danish Lindab brochure, 1994.
*Lindab Dachpfannen*, German Lindab brochure, 1994.
*Montering of bølgepladetage*, Dansk Eternit brochure, Aug. 1998.
*Integrated Sheet Metal Technology*, Samesor Oy brochure, early 1990's.

* cited by examiner

*Primary Examiner*—Richard Chilcot
(74) *Attorney, Agent, or Firm*—Weingarten, Schurgin, Gagnebin & Hayes LLP

(57) ABSTRACT

A roof cladding panel is profiled in its longitudinal direction and stepped in its transverse direction and comprises two straight side edges (4, 5) which are connectable to adjacent panels, a lower edge (2) which is generally wave-shaped and connectable to an adjacent panel, and an upper edge (3) which preferably is straight and connectable to an adjacent panel. Two diagonally opposite corners (8, 9) of the panel are obliquely cut, and an upper cut corner of one panel is adapted to be matchingly assembled with a lower cut corner of another panel in a four-corner joint including also non-cut corners of a third and a fourth roof cladding panel.

26 Claims, 4 Drawing Sheets

ROOF CLADDING ELEMENT, SYSTEM AND USE OF THE ELEMENTS

This is a continuation of International Application PCT/IB98/01493, with an international filing date of Sep. 24, 1998, now abandoned.

TECHNICAL FIELD

The present invention relates to roof cladding, and more specifically to roof cladding elements which are profiled in their longitudinal direction and stepped in their transverse direction.

BACKGROUND ART

In the nineties, the applicant has been marketing a roof cladding system under the trademark LindabTopline® which includes roof cladding elements of sheet metal of the type mentioned above. The LindabTopline® system is described in two Danish-language pamphlets "Gi' dit hus en ny profil . . . " and "Vejledning—projektering og montage" issued by Lindab Profil A/S in 1994, as well as in the German-language pamphlet "Lindab Dachpfannen" issued by Lindab VM GmbH. These known roof cladding elements are profiled in their longitudinal direction and thus have a wave-shaped cross-section. Further, the elements are stepped in their transverse direction for forming tile-like formations similar to traditional roof tiles of clay. The roof cladding elements are produced in roll-forming machines, for instance of the type described in a pamphlet "Integrated Sheet Metal Technology" issued by the Finnish company Samesor Oy.

Normally, the elements are delivered in lengths of several metres, so-called full length plates which require two people in mounting on the roof. Lately, however, there has been an increasing demand for shorter roof cladding elements of this type, so-called panels having a length of about 1–2 m which can be mounted by a single person. Such short roof cladding panels have several advantages: they can be stored in standard lengths, they can easily be placed on a small trailer for transport and they can easily be mounted on the roof by one person.

Short roof cladding panels of this principal type are disclosed in the Danish Utility Model Publication DK-U-96 00008 corresponding to the German Utility Model Publication DE-U-297 00 208. The rectangular panels shown in these publications have longitudinal waves or undulations and are stepped in the transverse direction for forming tile-like formations. Further, the upper and lower edge portions of the panel are cut generally wave-shaped.

However, the known roof cladding elements (plates and panels) sometimes suffer from some common disadvantages. When elements are used which do not extend over the full length of the roof, specific overlap problems occur. These problems are particularly noticeable when the roof cladding is built up from several short panels, in which case a plurality of four-corner joints are present on the roof. Since the panels are mounted in an overlapping manner, these four-corner joints include the corner portions of four adjacent panels. Due to the four-corner joints having four layers of sheet metal, there is a build-up in height throughout the roof cladding which makes it hard to mount the panels in a straight horizontal direction. Further, of course, the four-corner joints having four layers create the same problem in the longitudinal direction of the roof cladding.

Another disadvantage is that the person who mounts the roof cladding elements does not know where to put the fastening screws on the elements for attachment to the underlying supporting structure of the roof. The supporting structure is simply hidden by the panels.

SUMMARY OF THE INVENTION

An object of the present invention is to provide an improved roof cladding element, by means of which the above-mentioned disadvantages can be remedied. A particular object of the invention is to simplify and improve the mounting of the roof cladding elements.

These and other objects, which will appear from the following description, have now been achieved by a roof cladding element having the features defined in appended claim 1, preferred embodiments thereof being set forth in the subclaims 2–12. The objects of the invention are also achieved by a roof cladding system and the use of roof cladding elements in accordance with appended claims 13 and 14, respectively.

The roof cladding element of the invention is characterised in that two diagonally opposite corners thereof are obliquely cut. An upper cut corner portion of one roof cladding element is adapted to be matchingly assembled with a lower cut corner portion of another cladding element roof in a four-corner joint including also non-cut corner portions of a third and a fourth roof cladding element.

The invention confers several advantages. Since the four-corner joints only have two layers of material along the connection where the cut corner portions are put together, the former overlap inconvenience is avoided. In the area immediately adjoining said connection between the cut corner portions, there are only three layers of material. Further, the mounting of the roof cladding is simplified.

BRIEF DESCRIPTION OF THE DRAWINGS

The invention will be described more in detail in the following with reference to the accompanying drawings which show non-limiting embodiments of the invention.

DESCRIPTION OF PREFERRED EMBODIMENTS

Figure 1:
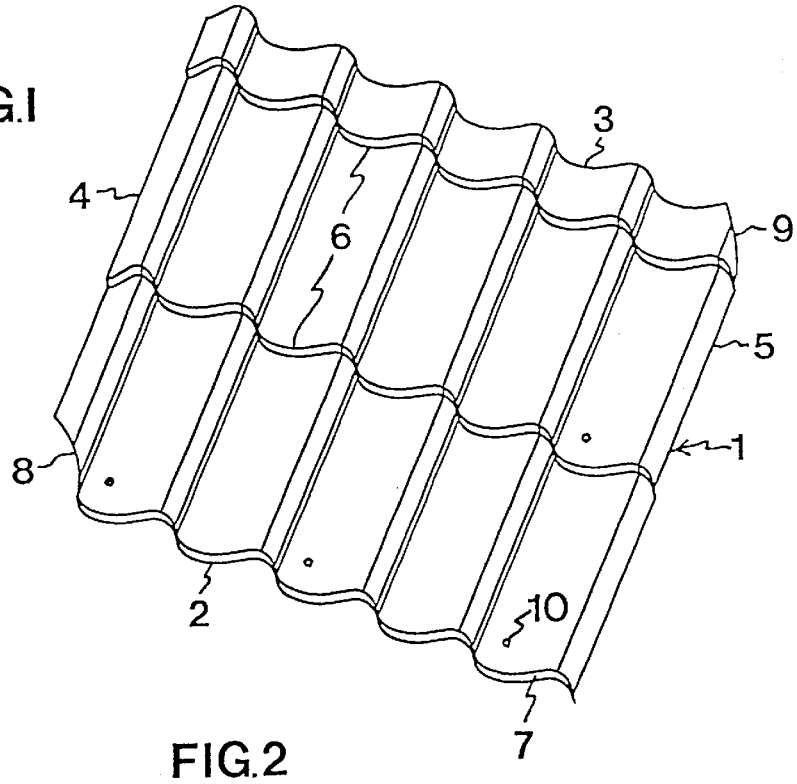
FIG. 1 is a perspective view of a short-tile roof cladding panel in accordance with the invention.
Figure 2:
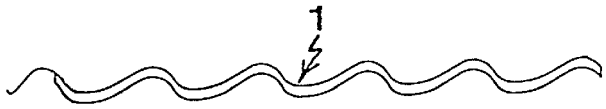
FIG. 2 is an end view of the panel of FIG. 1.

FIGS. 1–2 show a rectangular roof cladding element 1 according to an embodiment of the invention. The roof cladding element 1 is of the short type also referred to as a roof cladding panel which has a length of about 1–2 m. The panel 1 is profiled in its longitudinal direction and has a wave-shaped cross-section (see FIG. 2). The lower edge 2 of the panel 1 is cut wave-shaped whereas the upper edge 3 is cut straight (cf. FIG. 4). The sides 4, 5 of the panel are straight and adapted to be overlappingly connected to adjacent panels.

The panel 1 is stepped in its transverse direction, and the two steps are designated 6 in FIG. 1. The steps 6 define short tile-like formations. The lower edge 2 has the same wave-shape as the two steps 6. Further, the lower edge 2 has a downwardly directed flange 7 which will be described later on.

Two diagonally opposite corner portions 8, 9 of the panel 1 are obliquely cut as will be described in more detail below. Further, the panel 1 has fixed marks or nests 10 for fastening means, such as screws, which also will be described below. Preferably, these nests are formed as indentations in the upper surface of the panel 1.

Figure 3:
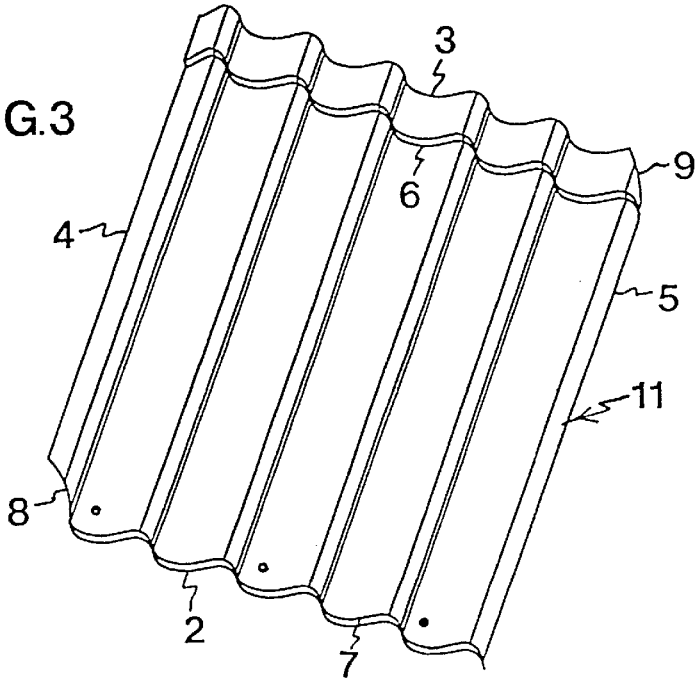
FIG. 3 is a perspective view of a long-tile roof cladding panel.

FIG. 3 shows a slightly modified panel 11 which corresponds to the roof cladding panel 1 but which is of the long-tile type.

Figure 8:
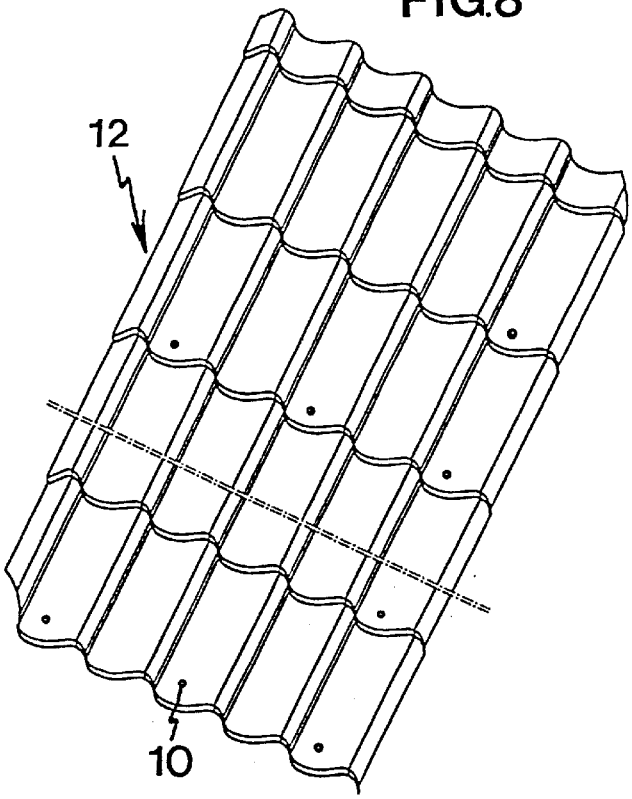
FIG. 8 is a perspective view of a short-tile roof cladding plate in accordance with the invention.
Figure 9:
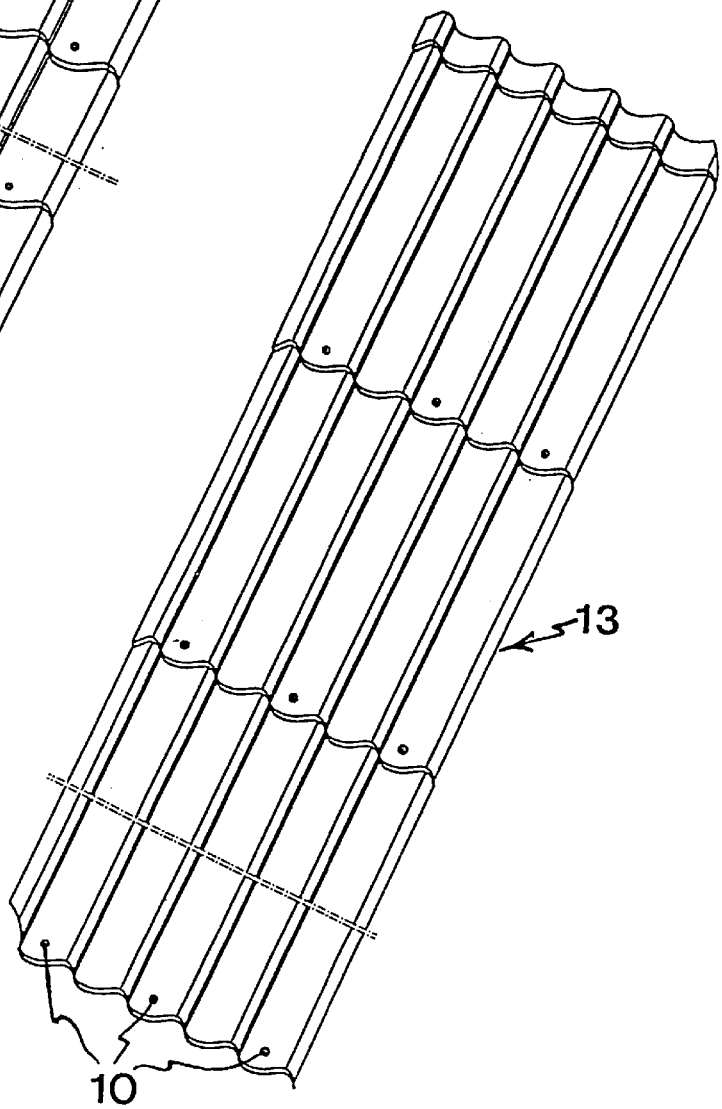
FIG. 9 is a long-tile roof cladding plate in accordance with the invention.

A long version of the roof cladding panel 1 is shown in FIG. 8. This short-tile plate 12 has several tile formations and can have a length of for instance about 4–6 m. A long-tile plate 13 is shown in FIG. 9 corresponding to the long-tile panel 11 shown in FIG. 3. It should be noted that the present invention is not limited to roof cladding elements of particular lengths, since the four-corner joint problem occurs every time there is at least one transverse joint between two elements of the roof cladding.

Figure 4:
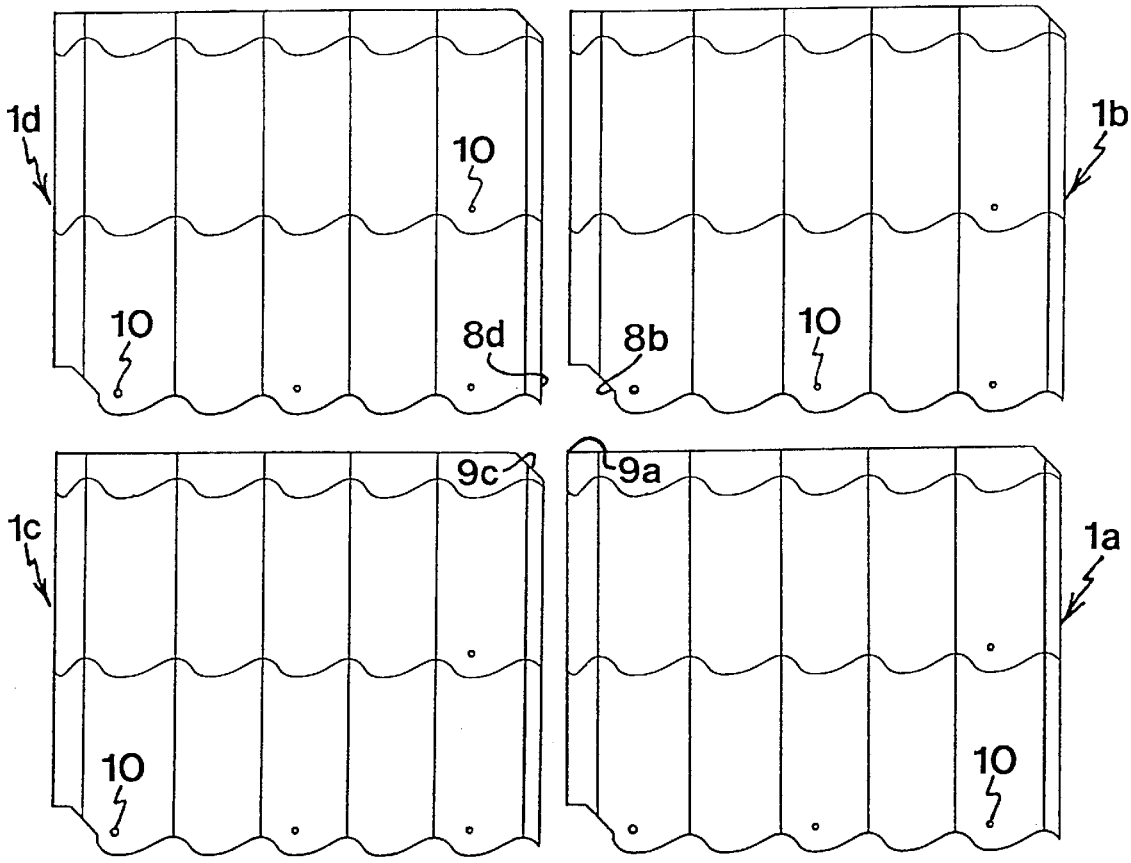
FIG. 4 is a plan view of four roof cladding panels as shown in FIG. 1 before assembling.
Figure 5:
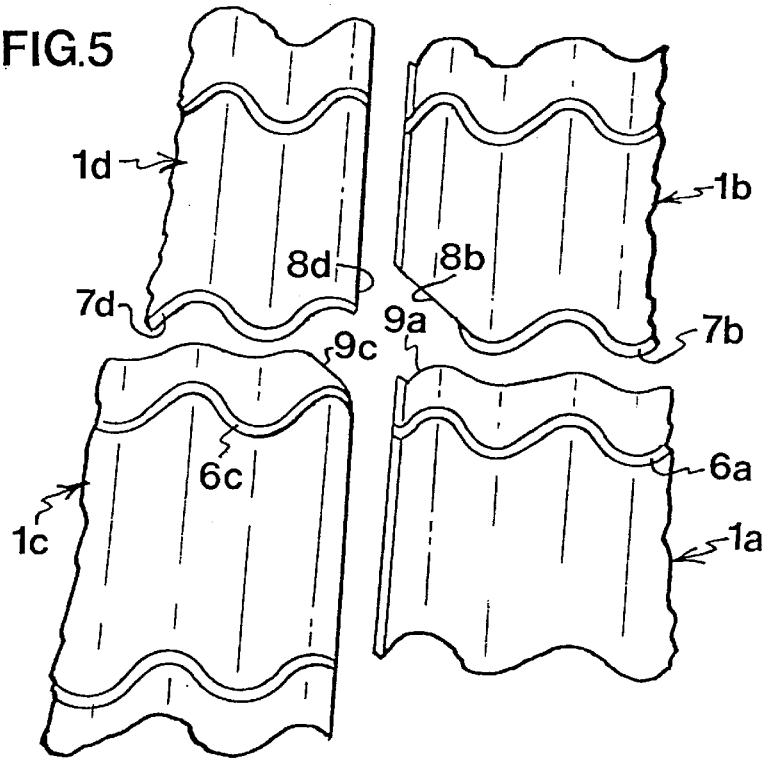
FIG. 5 is a perspective view of the four roof cladding panels shown in FIG. 4, portions of the four panels being cut away.

FIG. 4 shows from above four short-tile panels of the type shown in FIG. 1 before assembling. In order to simplify the understanding of the assembling of these four panels, they are designated 1*a*, 1*b*, 1*c* and 1*d* in FIG. 4. The same references are used in FIGS. 5–7.

The four panels 1*a*, 1*b*, 1*c*, 1*d* are assembled in the following manner. First, the first panel 1*a* is attached to the roof-supporting structure. Then, the second panel 1*b* is placed in an overlapping manner on the first panel 1*a*, the lower flange 7*b* being engaged with the step 6*a* of the first panel 1*a*. Thus, the lower edge portion of the second panel 1*b* overlaps the upper edge portion of the first panel 1*a*. The second panel 1*b* is fastened to the roof-supporting structure.

Figure 6:
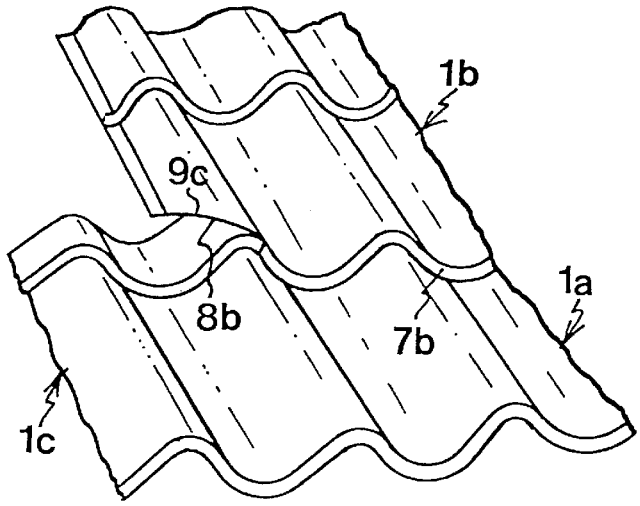
FIG. 6 is a perspective view of three of the four panels in assembling.

In the following step, the third panel 1*c* is connected to the first and second panels 1*a*, 1*b* as can be seen in FIG. 6. The adjacent side edge portions of the first panel 1*a* and the third panel 1*c* are overlapped. The obliquely cut lower corner portion 8*b* of the second panel 1*b* snugly fits to the profile of the third panel 1*c*. The cut corner portion 9*c* of the third panel 1*c* is put matchingly together with the cut corner portion 8*b* of the second panel 1*b* edge-to-edge. The third panel 1*c* is attached to the roof-supporting structure.

Figure 7:
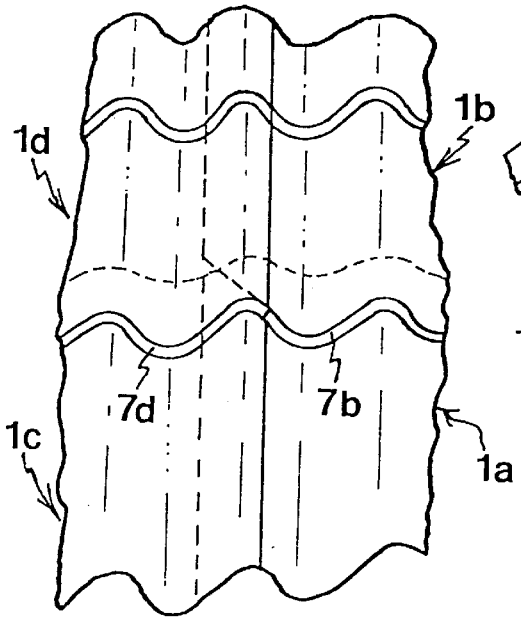
FIG. 7 is a perspective view of the four panels when assembled.

In order to finish the four-corner joint, the fourth panel 1*d* is connected to the three panels 1*a*, 1*b*, 1*c* in such way that the non-cut corner portion 8*d* of the fourth panel 1*d* is placed over the cut corner portions 8*b* and 9*c* of the first and third panels 1*b*, 1*c*, as is shown in FIG. 7. The flange 7*d* of the fourth panel 1*d* is engaged with the step 6*c* of the third panel 1*c*. The interconnected side edge portions of the second and the fourth panels 1*b* and 1*d* are overlapped. Seen from above, the two non-cut corner portions 8*d*, 9*a* of the first and the fourth panels 1*a*, 1*d* are overlapped as well with the edge connection of the cut corner portions 8*b*, 9*c* therebetween. The fourth panel 1*d* is fastened to the roof-supporting structure.

Thus, it is the adjacent corner portions 8*b*, 9*c* of two diagonally mounted panels 1*b*, 1*c* that are obliquely cut. This principle is common for all four-corner joints all over the roof cladding which is built up by several panels of the type described.

Since the lower edge of the panel 1 is wave-shaped, the same panel 1 can be used close to the gutter or anywhere in the roof cladding.

As can be clearly seen from FIGS. 6–7, the four-corner joint connection is such that the wave-shaped steps of the panels are continuous in the horizontal direction. It is also understood that there are only two layers of sheet metal along the connection where the edges of the cut corner portions 8*b*, 9*c* are put together, which eliminates the four-layer overlap problem described by way of introduction. These two layers are the non-cut corner portions 9*a*, 8*d* of the first and the fourth panels 1*a*, 1*d*. In the area surrounding said edge connection 8*b*, 9*c*, there are of course three layers of sheet metal.

Preferably, the edge-to-edge connection between the two cut corner portions 8*b*, 9*c* is rather tight. In particular, it is preferred that the edges 8*b*, 9*c* are in abutment with each other in the area where the flanges 7*b* and 7*d* of the second and third panels 1*b*, 1*c* meet, whereas there may be a small play (a few millimetres) in the rest of the edge connection, see FIG. 6. This small play facilitates the connection of the panels in mounting.

It should be noted that the panels and plates 1, 11, 12, 13 may be of other designs within the scope of the invention. For instance, it is preferred that the upper edge portion 3 of the roof cladding element is substantially straight, but alternatively the upper edge portion may be wave-shaped in accordance with the steps 6 and the lower edge portion 2. Further, it is preferred that the profiling and tile formations of the roof cladding element may vary in accordance with aesthetical desires and requirements.

A typical short-tile roof cladding panel 1 in accordance with the invention has a length of 1220 mm and a width of 1095 mm.

Figure 10:
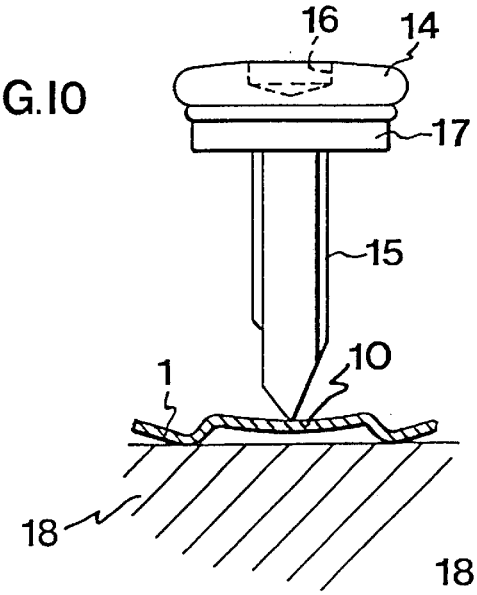
FIGS. 10 and 11 are side views, partly in section, showing a screw for fastening a roof cladding element of the invention to a supporting member.
Figure 11:
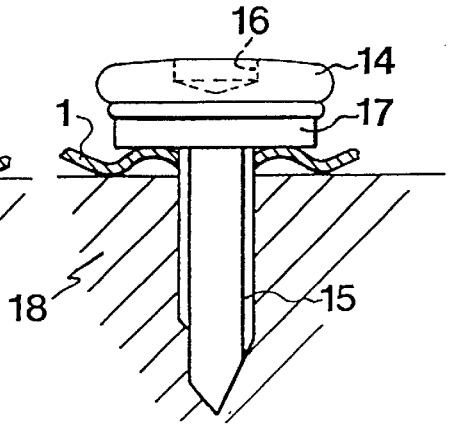

FIGS. 10–11 show a self-drilling screw with a head 14 and a threaded shank 15. The screw head 14 has a recess 16 for a screwdriver (not shown), and an annular rubber sealing 17 is mounted on the shank 15. When mounting the roof cladding element 1 on a roof-supporting member 18, the tip of the screw shank 15 is placed in one of the screw nests in the shape of an indentation 10 in the upper surface of the element 1, whereupon the screw 14, 15 is drillingly driven into the supporting member 18, causing a special deformation of the indentation 10. A very tight and secure fastening of the roof cladding element 1 is accomplished.

The screw nests or indentations 10 are arranged on the elements 1 in accordance with a predetermined pattern, which corresponds to the arrangement of the underlying roof-supporting members 18. Thanks to these fixed indentations 10, the roof-mounting personnel just have to place the fastening screws 14, 15 in the indentations 10 and activate the screwdriver which preferably is of the automatic type.

Since the underlying roof-supporting members 18 are arranged in accordance with standard lengths of the roof cladding plates and panels having fixed screw nests 10, it does not matter that the roof-supporting structure is hidden to the person mounting a roof cladding since there is a roof supporting member under each screw nest 10. This makes the assembling of the roof cladding much easier and quicker.

It is appreciated that the inventive concept by no means is restricted to the embodiments described, and several modifications are feasible within the general scope of the invention defined in the appended claims. The specific appearance of the roof cladding element is not crucial as long as the element has the main features of the invention, especially in relation to the solution of the four-corner joint problem. Although the preferred material of the plates and panels is sheet metal, other materials can be used as well.

What is claimed is:

1. A roof cladding element comprising:

a rectangular panel or plate comprising a cross-sectional profile extending in a longitudinal direction, two longitudinally-extending straight side edge portions, a transversely-extending lower edge portion varying longitudinally in a generally wave shape, a transversely-extending upper edge portion, a transversely-extending step formed in the panel or plate, and four corners;

a first upper corner and a first lower corner diagonally opposite the first upper corner, the upper corner and the lower corner being obliquely cut at matching angles; and a second upper corner and a second lower corner diagonally opposite the second upper corner being non-cut.

2. A roof cladding element as claimed in claim 1, wherein said obliquely cut corner portions are adapted to be put together edge-to-edge.

3. A roof cladding element as claimed in claim 1, wherein the edges of said obliquely cut corner portions are at least partially in abutment with each other.

4. A roof cladding element as claimed in claim 1, wherein said upper edge portion of the element is substantially straight.

5. A roof cladding element as claimed in claim 1, wherein said two cut corner portions are cut in such a way that they snugly fit to the profile of said adjacent non-cut corner portions.

6. A roof cladding element as claimed in claim 1, wherein the transversely-extending step of the element has the same wave-like shape as said lower edge portion thereof.

7. A roof cladding element as claimed in claim 6, wherein said lower edge portion has a wave-shaped flange connectable to a matchingly wave-shaped step of an underlying roof cladding element.

8. A roof cladding element as claimed in claim 1, wherein the profile of the element is wave-shaped in cross-section.

9. A roof cladding element as claimed in claim 1, wherein the element is a plate or panel of sheet metal.

10. A roof cladding element as claimed in claim 1, wherein the transversely-extending step of the element defines tile-shaped formations.

11. A roof cladding element as claimed in claim 1, wherein the element has fixed marks or nests for fastening means for controlled fastening of the element on underlying roof support members.

12. A roof cladding element as claimed in claim 11, wherein said marks or nests are formed as indentations in the upper surface of the element.

13. A roof cladding system comprising roof cladding elements as defined in claim 1.

14. A method of assembling roof cladding elements for forming a roof cladding, said elements comprising roof cladding elements as defined in claim 1.

15. A roof cladding element as claimed in claim 1, wherein:

the edges of said obliquely cut corner portions are at least partially in abutment with each other;

said upper edge portion of the element is substantially straight;

said two cut corner portions are cut in such a way that they snugly fit to the profile of said adjacent non-cut corner portion;

the transverse steps of the element have the same wave-like shape as said lower edge portion thereof;

said lower edge portion has a wave-shaped flange for connection to a matchingly wave-shaped step of an underlying roof cladding element;

the profile of the element is wave-shaped in cross-section;

the element is a plate or panel of sheet metal;

the transversely-extending step of the element defines tile-shaped formations;

the element has fixed marks or nests for self-drilling screws, for controlled fastening of the element on underlying roof support members; and said nests or marks are formed as indentations in the upper surface of the element.

16. A roof cladding system, comprising roof cladding elements as defined in claim 15.

17. The roof cladding element of claim 1, wherein the transversely-extending lower edge portion is cut to the generally wave shape.

18. A roof cladding element comprising:

a rectangular panel or plate of sheet metal comprising a cross-sectional profile extending in a longitudinal direction, two longitudinally-extending straight side edge portions, a transversely-extending lower edge portion varying longitudinally in a generally wave shape, a transversely-extending upper edge portion, a transversely-extending step formed in the panel or plate, the transversely-extending step having the generally wave shape of the lower edge portion, and four corners;

a first upper corner and a first lower corner diagonally opposite the first upper corner, the upper corner and the lower corner being obliquely cut at matching angles; and a second upper corner and a second lower corner diagonally opposite the second upper corner being non-cut.

19. A roof cladding system comprising:

a first roof cladding element, a second roof cladding element, a third roof cladding element, and a fourth roof cladding element, each roof cladding element comprising:

a rectangular panel or plate comprising a cross-sectional profile extending in a longitudinal direction, two longitudinally-extending straight side edge portions, a transversely-extending lower edge portion varying longitudinally in a generally wave shape, a transversely-extending upper edge portion, a transversely-extending step formed in the panel or plate, and four corners;

a first upper corner and a first lower corner diagonally opposite the first upper corner, the upper corner and the lower corner being obliquely cut at matching angles; and a second upper corner and a second lower corner diagonally opposite the second upper corner being non-cut;

the roof cladding elements assemblable to form a four-corner joint in which the obliquely cut first upper corner of the third element abuts the obliquely cut first lower corner of the second element, the abutting corners forming a middle layer between the second upper non-cut corner of the first element and the second lower non-cut corner of the fourth element.

20. The roof cladding system of claim 19, wherein the transversely-extending step of each roof cladding element includes a same generally wave shape as the lower edge portion.

21. The roof cladding system of claim 19, wherein the panel or plate of each roof cladding element comprises sheet metal.

22. A method of assembling roof cladding elements, comprising:

providing at least four roof cladding elements, each roof cladding element comprising:

a rectangular panel or plate comprising a cross-sectional profile extending in a longitudinal direction, two longitudinally-extending straight side edge portions, a transversely-extending lower edge portion varying longitudinally in a generally wave shape, a transversely-extending upper edge portion, a transversely-extending step formed in the panel or plate, and four corners;

a first upper corner and a first lower corner diagonally opposite the first upper corner, the upper corner and the lower corner being obliquely cut at matching angles; and a second upper corner and a second lower corner diagonally opposite the second upper corner being non-cut;

attaching a first element to a roof supporting structure;

attaching a second element to the roof supporting structure with the lower edge portion of the second element overlapping the upper edge portion of the first element;

attaching a third element to the roof supporting structure overlapping the first element along adjacent side edges, the obliquely cut lower corner of the second element abutting the obliquely cut upper corner of the third element; and attaching a fourth element to the roof supporting structure, the non-cut lower corner overlapping the abutting obliquely cut lower corner and obliquely cut upper corner, and the lower edge portion of the fourth element overlapping the upper edge portion of the third element, and overlapping the second element along adjacent side edges.

23. The method of claim 22, further comprising attaching the first element, the second element, the third element, and the fourth element to the roof supporting structure with screws.

24. The method of claim 22, wherein in the providing step, the transversely-extending step of each roof cladding element includes a same generally wave shape as the lower edge portion.

25. The method of claim 22, wherein in the providing step, the panel or plate of each roof cladding element comprises sheet metal.

26. The method of claim 22, wherein the providing step further comprises cutting the transversely-extending lower edge portion to the generally wave shape.

* * * * *